US007748588B2

(12) United States Patent
Osuga et al.

(10) Patent No.: US 7,748,588 B2
(45) Date of Patent: Jul. 6, 2010

(54) POWERED NAILING MACHINE

(75) Inventors: Satoshi Osuga, Tokyo (JP); Eiichi Watanabe, Tokyo (JP)

(73) Assignee: Max Co., Ltd., Tokyo (JP)

( * ) Notice: Subject to any disclaimer, the term of this patent is extended or adjusted under 35 U.S.C. 154(b) by 191 days.

(21) Appl. No.: 11/664,811

(22) PCT Filed: Sep. 20, 2005

(86) PCT No.: PCT/JP2005/017300

§ 371 (c)(1),
(2), (4) Date: Apr. 6, 2007

(87) PCT Pub. No.: WO2006/040909

PCT Pub. Date: Apr. 20, 2006

(65) Prior Publication Data

US 2008/0245839 A1 Oct. 9, 2008

(30) Foreign Application Priority Data

Oct. 8, 2004 (JP) ..... 2004-296271

(51) Int. Cl.
*B25C 1/04* (2006.01)

(52) U.S. Cl. ..... 227/120; 227/10; 227/119; 227/127; 227/128

(58) Field of Classification Search ..... 227/10, 227/120, 119, 127, 128
See application file for complete search history.

(56) References Cited

U.S. PATENT DOCUMENTS 3,708,095 A * 1/1973 Briggs, Jr. ..... 227/126
3,905,535 A * 9/1975 Novak et al. ..... 227/120
4,304,349 A * 12/1981 Novak et al. ..... 227/109
4,463,888 A 8/1984 Geist et al.
5,522,533 A * 6/1996 Mukoyama et al. ..... 227/109
5,813,588 A * 9/1998 Lin ..... 227/109
6,032,848 A 3/2000 Smolinski
6,092,711 A * 7/2000 Tinarelli ..... 227/109
6,173,877 B1 * 1/2001 Wingert ..... 227/109
6,598,777 B2 * 7/2003 Osuga et al. ..... 227/136
6,708,861 B2 * 3/2004 Osuga et al. ..... 227/120
7,040,522 B2 * 5/2006 Osuga et al. ..... 227/119
2002/0033407 A1 * 3/2002 Osuga et al. ..... 227/120
2002/0060234 A1 * 5/2002 Osuga et al. ..... 227/120

(Continued)

FOREIGN PATENT DOCUMENTS

JP 64-46177 3/1989

(Continued)

*Primary Examiner*—Brian D Nash
(74) *Attorney, Agent, or Firm*—Drinker Biddle & Reath LLP

(57) ABSTRACT

A magazine includes guide portions formed at a pair of side walls to be opposed to each other for introducing to guide a portion of a nail shaft portion, an opening portion formed on a base end side of a nose portion relative to the guide portion of one of the side walls, a first attaching portion formed on a front end side of the nose portion relative to the guide portion of the one side wall, a second attaching portion formed on the base end side of the nose portion relative to the guide portion of the other side wall, and a notched portion formed on the front end side of the nose portion relative to the guide portion of the other side wall.

8 Claims, 5 Drawing Sheets

U.S. PATENT DOCUMENTS

2004/0169057 A1* 9/2004 Ronconi ..... 227/109
2004/0246091 A1* 12/2004 Osuga et al. ..... 337/120
2005/0001007 A1* 1/2005 Butzen et al. ..... 227/130
2005/0121490 A1* 6/2005 Sun ..... 227/120
2005/0127128 A1* 6/2005 Osuga et al. ..... 227/119
2005/0150927 A1* 7/2005 Tadayoshi et al. ..... 227/109
2006/0157528 A1* 7/2006 Osuga et al. ..... 227/130

FOREIGN PATENT DOCUMENTS

JP 6-53071 7/1994
JP 2000-141247 5/2000
JP 2002-337068 11/2002

* cited by examiner

POWERED NAILING MACHINE

TECHNICAL FIELD

The present invention relates to a power drive nailing machine for striking a fastener of a nail, a pin or the like supplied into an injection port of a nose portion by a driver coupled to a piston to a struck member of wood, concrete, or a steel plate or the like by impulsively driving the piston contained at inside of a cylinder by a pressure of compressed air or a combustion gas or the like.

BACKGROUND ART

As a power drive nailing machine, there is a compressed air drive nailing machine, a combustion gas drive nailing machine or the like. The compressed air drive nailing machine drives a piston contained at inside of the cylinder by introducing compressed air into the cylinder and strikes a nail to a struck member of wood or the like by a driver coupled to a piston. The combustion gas drive nailing machine is formed with a combustion chamber at inside of a housing for generating a combustion gas at high pressure by combusting a combustible gas at inside of the combustion chamber, operating the combustion gas to a piston to be impulsively driven at inside of a cylinder, and striking a nail to a steel plate or concrete by a driver coupled to the piston.

The power drive nailing machine contains an impulse mechanism comprising a cylinder and a piston slidably contained at inside of the cylinder and a driver or the like integrally coupled to a side of a lower face of the piston at inside of a housing. A lower side of the housing is coupled with a nose portion formed with an injection port for striking and guiding a nail to a work member. The driver coupled to the lower face of the piston of the impulse mechanism contained at inside of the cylinder is contained in and guided by the injection port. Further, the nail supplied into the injection port of the nose portion is struck by the driver of the strike mechanism to be struck to a struck member arranged on a side of a front end of the nose portion.

According to the power drive nailing machine, in order to continuously supply nails into the injection port of the nose portion, the nose portion is connected with a magazine made to be able to charge a connected nail constituted by connecting a number of nails to each other by shaft portions thereof. Nails having a comparatively large dimension used in the power drive nailing machine are formed as a connected nail in a straight shape constituted by connecting shaft portions thereof to each other by a connecting band in a state in which the shaft portions of the nails are aligned planarly to be in parallel with each other. According to the power drive nailing machine using the connected nail in the straight shape, the magazine is formed by a shape of a straight sheath by side walls for guiding two side faces of the connected nail in the straight shape. A front end portion of the magazine in the shape of the straight sheath is connected to attach to a rear side of the nose portion. Further, inside of the magazine in the shape of the straight sheath and inside of the injection port are communicated by way of an opening formed on the rear side of the nose portion. Front nails of the connected nail charged into the magazine are successively supplied into the injection port of the nose portion.

According to the power drive nailing machine, there is brought about a rare case in which the nail is clogged at inside of the injection port by being buckled or the like when the nail arranged at inside of the injection port is struck by the driver to be struck out from the injection port. The nail clogged at inside of the injection port in this way is frequently bent at inside of the injection port or solidly engaged with the driver. Therefore, in order to exclude the nail from inside of the injection port, the nail is removed by engaging a tool of a punch or the like directly with the clogged nail and applying an impulse thereto by a hammer. An ordinary magazine is formed with a pusher for pressing the connected nail charged into the magazine to urge in a direction of the injection port. An opening for exposing an operating portion for operating to move the pusher in a rear direction to a side of a side face of the magazine is formed along the side face of the magazine. Although a portion of the injection port is exposed by a portion of the opening, the opening is formed at an upper portion of the nose portion, and the tool of the punch or the like cannot be inserted into a lower portion of the injection port at which the nail is clogged ordinarily.

JP-A-2002-337068 discloses a power drive nailing machine in which a portion of a front portion of a nose portion forming an injection port is openly/closably formed as a separate part and the injection port clogged with a nail is exposed to outside by opening/closing the portion in order to open the injection port clogged with a nail to outside when the nail is clogged at inside of the injection port. According to the power drive nailing machine, the front portion of the nose portion forming the injection port is formed with a portion of a front wall of the injection port as a front plate as a separate member openable/closable relative to the nose portion. The front plate arranged at a closed position in an ordinary case is pivoted to an open position when the nail is clogged at inside of the injection port, inside of the injection port is opened, and a tool of a punch or the like can be engaged with the nail clogged at inside of the injection port.

Further, in an ordinary power nailing machine, a magazine connected to a nose portion is detached from the nose portion, an injection port is opened by rotating a front end portion of the magazine in a direction of being remote from the injection port of the nose portion, a nail clogged at inside of the injection port is butted by a tool of a punch or the like to thereby remove the nail. However, in order to remove the magazine from the nose portion, a tool of a screwdriver, a wrench or the like is needed for relaxing a bolt or the like for attaching the magazine to the nose portion. Further, the tool needs to be used again also when the magazine is attached to the nose portion after removing the clogged nail from inside of the injection port. There poses a problem that an operation of detaching and attaching the magazine by using the tool is extremely troublesome.

Further, although there is a power nailing machine capable of easily removing a nail clogged at inside of an injection port by forming an openable/closable front plate on a front side of a nose portion or forming an openable/closable door portion between a nose portion and a magazine and opening the injection port of the nose portion by opening the front plate or the door portion as in the power nailing machine of JP-A-2002-337068, according to the power nailing machine, it is necessary to form a separate part of an openable plate for opening inside of the injection port at nose portion, or the openable/closable door portion between the nose portion and the magazine, there is also needed a part of a latch mechanism or the like for holding the plate or the door portion at a closed position at ordinary time to pose a problem of constituting a factor of an increase in weight and an increase in cost by adding the part.

DISCLOSURE OF THE INVENTION

One or more embodiments of the invention provide a power drive mailing machine capable of easily removing a nail clogged at inside of an injection port of a nose portion with no need of forming an openable/closable separate part for opening the injection port of the nose portion or a troublesome operation of removing a magazine from the nose portion.

According to one or more embodiments of the invention, a power drive nailing machine is provided with a driver for striking a nail, a nose portion including an injection port for sliding to guide the driver, a magazine charged with a connected nail, successively supplying the connected nail into the injection port and having a pair of side walls, a guide portion formed such that the guide portion and each of the pair of side walls are opposed to each other and engaged with a side face of the connected nail for introducing to guide a portion of a nail shaft portion of the connected nail, an opening portion formed at one of the pair of side walls on a base end side of the nose portion relative to the guide portion, and a notched portion formed at other of the pair of side walls on a front end side of the nose portion relative to the guide portion.

Further, according to one or more embodiments of the invention, the power drive nailing machine is further provided with a first attaching portion formed at the one of the pair of side walls on the front end side of the nose portion relative to the guide portion for attaching the magazine to the nose portion, and a second attaching portion formed at the other of the pair of side walls on the base end side of the nose portion relative to the guide portion for attaching the magazine to the nose portion.

Further, according to one or more embodiments of the invention, the power drive nailing machine is further provided with a first and a second attaching piece formed integrally with the nose portion and projected to a rear side. The first attaching portion is attached to the first attaching piece, and the second attaching portion is attached to the second attaching piece.

Further, according to one or more embodiments of the invention, the guide portion guides a side face of a portion of the connected nail having a shortest size capable of being used by the power drive nailing machine proximate to a front end of the nail shaft portion.

Further, according to one or more embodiments of the invention, the connected nail comprises a number of nails connected in a straight shape, and the magazine is constituted by a straight shape.

Further, according to one or more of embodiments of the invention, the guide portions respectively include guide rods embedded in the side walls.

Further, according to one or more embodiments of the invention, the power drive nailing machine further comprises a pusher for urging the connected nail charged to the magazine to a side of the injection port. The opening portion guides the pusher.

According to one or more of embodiments of the invention, in the power drive mailing machine, the magazine includes the guide portion formed such that the guide portion and each of the pair of side walls are opposed to each other for engaging with the side face of the connected nail to introduce to guide a portion of the nail shaft portion of the connected nail, the opening portion formed at one of the pair of side walls to be disposed on the base end side of the nose portion relative to the guide portion for urging the connected nail charged to the magazine to the side of the injection port, the first attaching portion formed at the one of the pair of side walls to be disposed on the front end side of the nose portion relative to the guide portion for attaching the magazine to the nose portion, the second attaching portion formed at the other of the pair of side walls to be disposed on the base end side of the nose portion relative to the guide portion for attaching the magazine to the nose portion, and the notched portion formed at a portion reaching a vicinity of the second attaching portion from a vicinity of the first attaching portion by way of a portion disposed on a nail front side of the connected nail. The magazine is attached to the nose portion by way of the first attaching portion and the second attaching portion. Therefore, inside of the injection port can face outside from the opening portion and the notched portion. As a result, a tool of a punch or the like can be engaged with the nail clogged at inside of the injection port of the nose portion from the opening portion and the notched portion formed at the magazine without forming an openable/closable front plate at the nose portion or forming an openable/closable door portion between the nose portion and the magazine, or carrying out a troublesome operation of removing the magazine from the nose portion. Therefore, the nail clogged at inside of the injection port of the nose portion can easily be removed without increasing weight or cost of the power drive nailing machine. Particularly, the second attaching portion is provided to be disposed on a side upward from the guide portion on the other side of the pair of side walls and therefore, the notched portion on the other side of the pair of side walls can be opened by a large amount, and the nail clogged at inside of the injection port can further preferably be removed.

Other aspects and advantages of the invention will be apparent from the following description and the appended claims.

DESCRIPTION OF REFERENCE NUMERALS AND SIGNS

Figure 1:
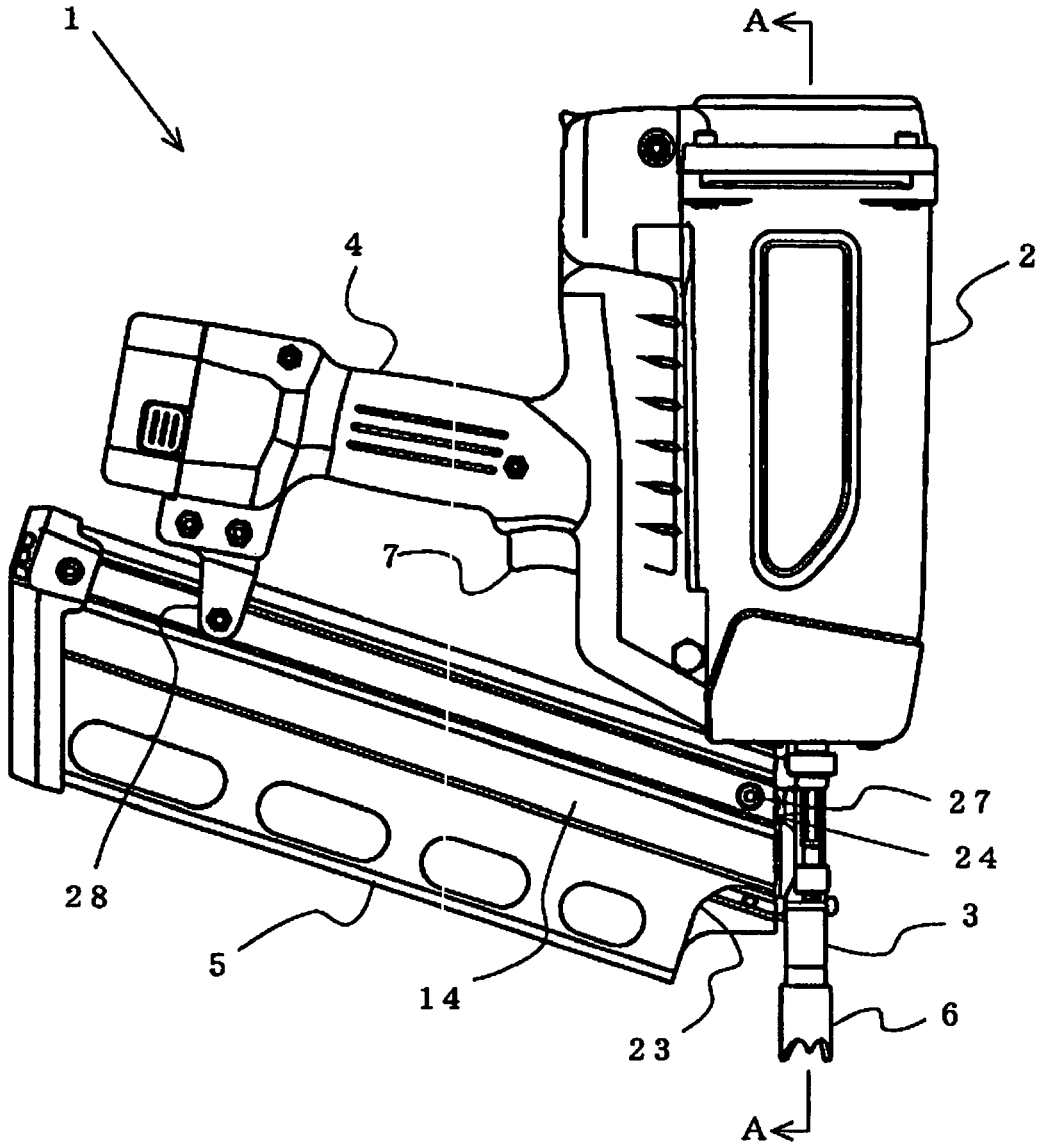
FIG. 1 is a side view of a power drive nailing machine.

1 . . . power drive nailing machine
5 . . . magazine
12 . . . injection port
13, 14 . . . side walls
16 . . . opening portion
19 . . . guide portion
22 . . . first attaching portion
23 . . . notched portion
24 . . . second attaching portion

BEST MODE FOR CARRYING OUT THE INVENTION

An embodiment of the invention will be explained in reference to the drawings as follows.

Embodiment 1

FIG. 1 shows a power drive nailing machine according to an embodiment of the invention. The power drive nailing machine 1 is constituted by a housing 2 containing an impulse mechanism, a nose portion 3 formed with an injection port for guiding a nail to a struck member and attached to a lower end portion of the housing 2, and a magazine 5 supported between a grip portion 4 integrally formed with a rear side of the housing 2 and a rear side of the nose portion 3 and containing a number of nails. The power drive nailing machine 1 includes a contact member 6 arranged to project in a direction of a front end of the nose portion 3 at ordinary time. The power drive nailing machine 1 is started by bringing the contact member 6 into contact with a struck member to be operated to slide along the nose portion 3 and operating a trigger 7 formed at a base portion of the grip portion 4.

Figure 2:
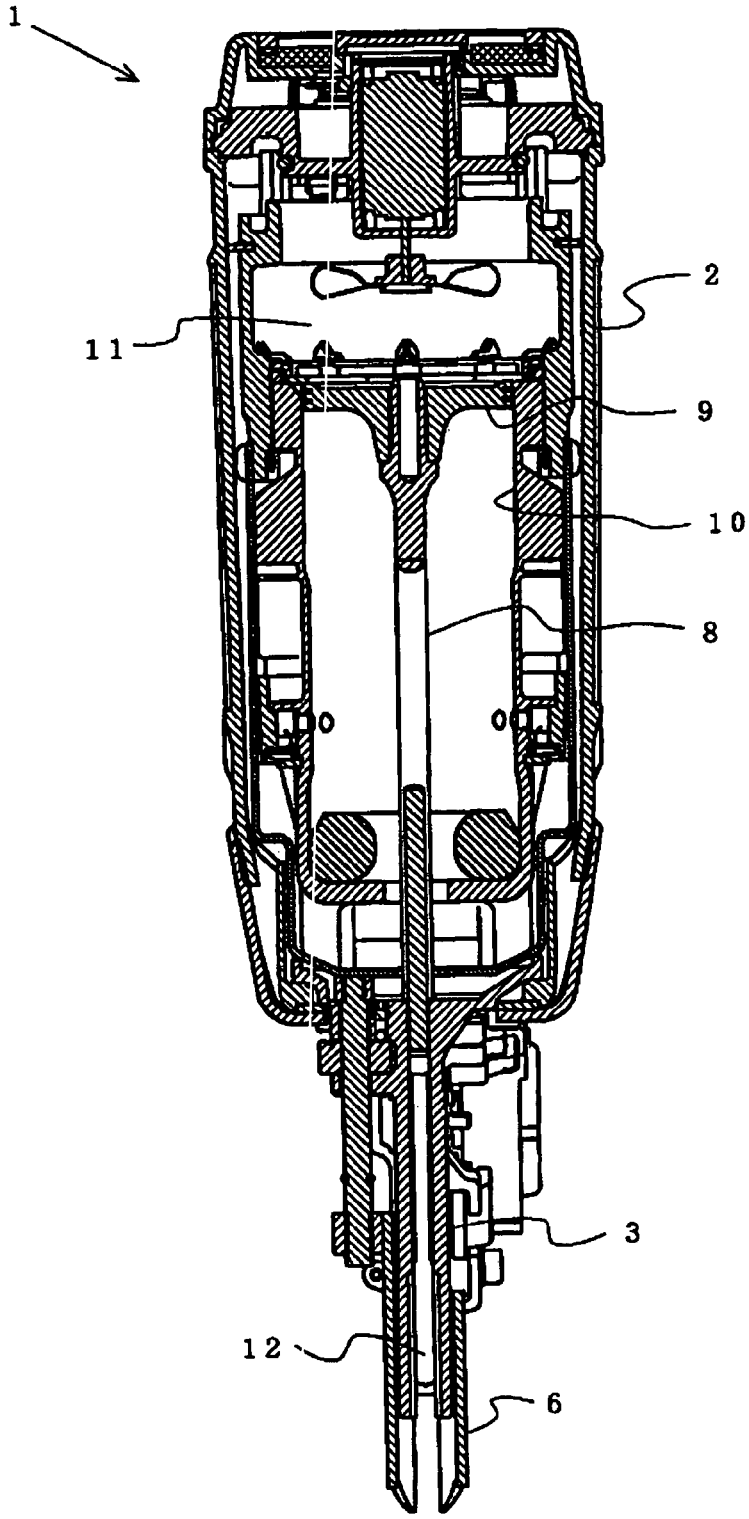
FIG. 2 is a sectional view taken along a line A-A of FIG. 1.

As shown by FIG. 2, the power drive nailing machine 1 of the embodiment is constituted as a nailing machine of a combustion gas drive type for driving a piston by a pressure of a combustion gas. Inside of the housing 2 of the power drive nailing machine 1 is contained with a cylinder 10 containing a piston 9 integrally coupled with a driver 8 for striking a nail on a side of the lower face thereof. An upper end of the cylinder 10 is formed with a combustion chamber 11 for combusting a combustible gas. An upper face of the piston 9 contained at inside of the cylinder is made to face the combustion chamber 11. The piston 9 is driven at inside of the cylinder 10 by the pressure of the combustion gas generated by combusting the combustible gas at inside of the combustion chamber 11. The combustible gas is charged in a vessel of, for example, a gas cylinder or the like and the vessel is mounted to inside of the housing 2. By operating the contact member 6, the combustion chamber 11 is hermetically closed and the combustible gas is supplied into the hermetically-closed combustion chamber 11. The supplied combustible gas is mixed with air at inside of the combustion chamber 11 to produce a mixture gas. By operating the trigger 7, the mixture gas is ignited and the combustion gas at high pressure is generated at inside of the combustion chamber 11. By operating the combustion gas to the piston 9, the piston 9 is driven at inside of the cylinder 10.

As shown by FIG. 2, the nose portion 3 attached to the lower portion of the housing 2 is formed with the injection port 12 for striking and guiding a nail to a struck member. The driver 8 coupled to the piston 9 is contained in and slidably guided by the injection port 12. Further, the injection port 12 is communicated with the magazine 5 connected to the rear side of the nose portion 3, and the nails charged into the magazine 5 are successively supplied to inside of the injection port 12. Further, by driving the piston 9 at inside of the cylinder 10 by the combustion gas, the driver 8 is driven at inside of the injection port 12, and the nail supplied into the injection port 12 is struck from inside of the injection port 12 to a struck member arranged at a front end of the nose portion 3.

Figure 3:
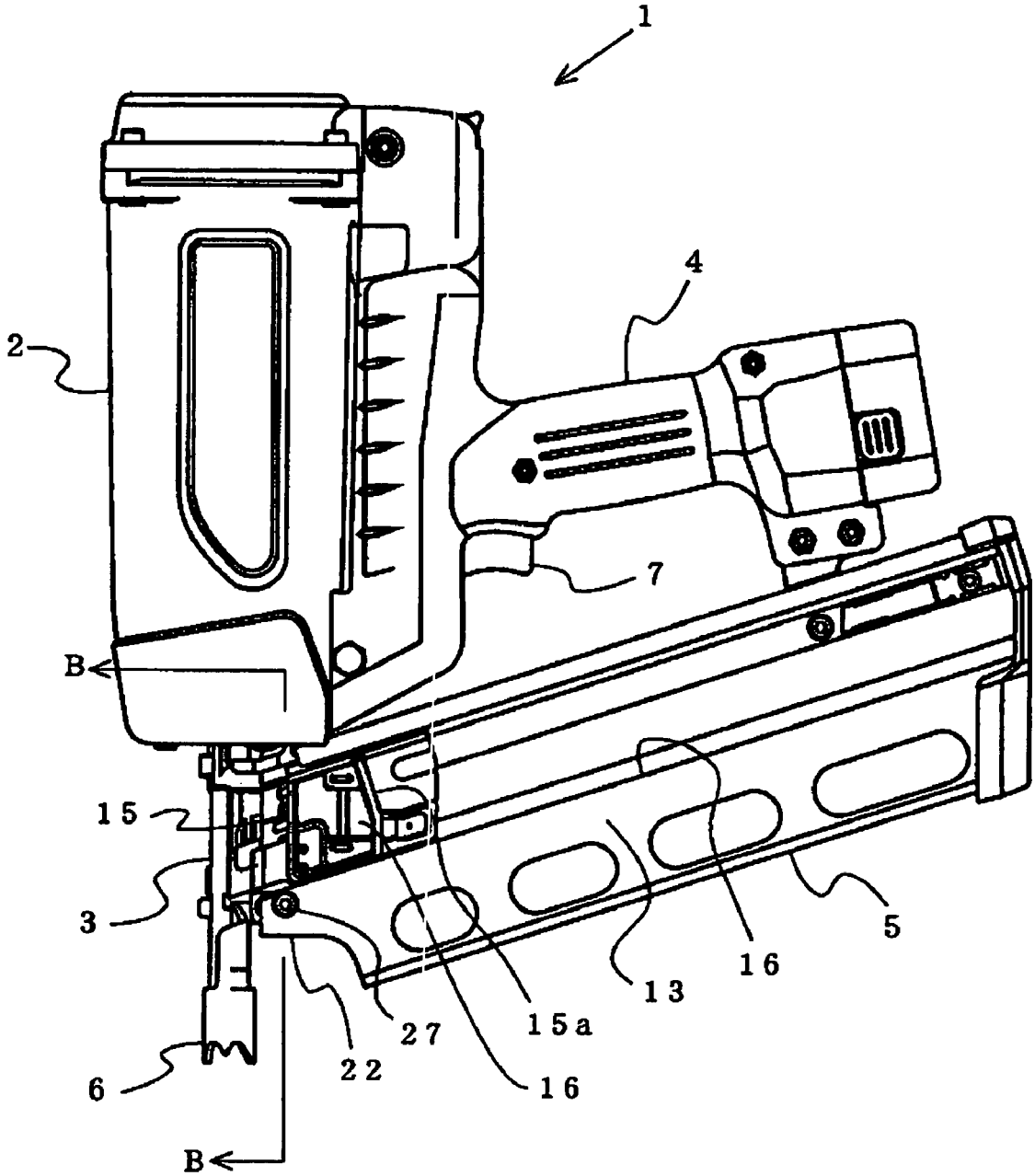
FIG. 3 is a side view showing a side face opposed to a side face of the power drive nailing machine of FIG. 1.

The nail used in the power drive nailing machine 1 is a connected nail in a straight shape constituted by connecting shaft portions of the respective nails by a connecting band of a synthetic resin or the like in a state of planarly aligning a number of nails such that the shaft portions of the respective nails are in parallel with each other. The magazine 5 is formed in a shape of a straight sheath including a pair of side walls 13, 14 for guiding two side faces of the connected nail in the straight shape. As shown by FIG. 3, the magazine 5 is arranged with a pusher 15 engaged with a rearmost nail of the connected nail charged into the magazine 5 for pressing to urge the connected nail to a front side of the magazine 5. The side wall 13 on one side of the magazine 5 is formed with the opening portion 16 for exposing an operating portion 15*a* for operating to pull back the pusher 15 to a rear side at a side face of the magazine 5 along a longitudinal direction of the magazine 5.

Figure 4:
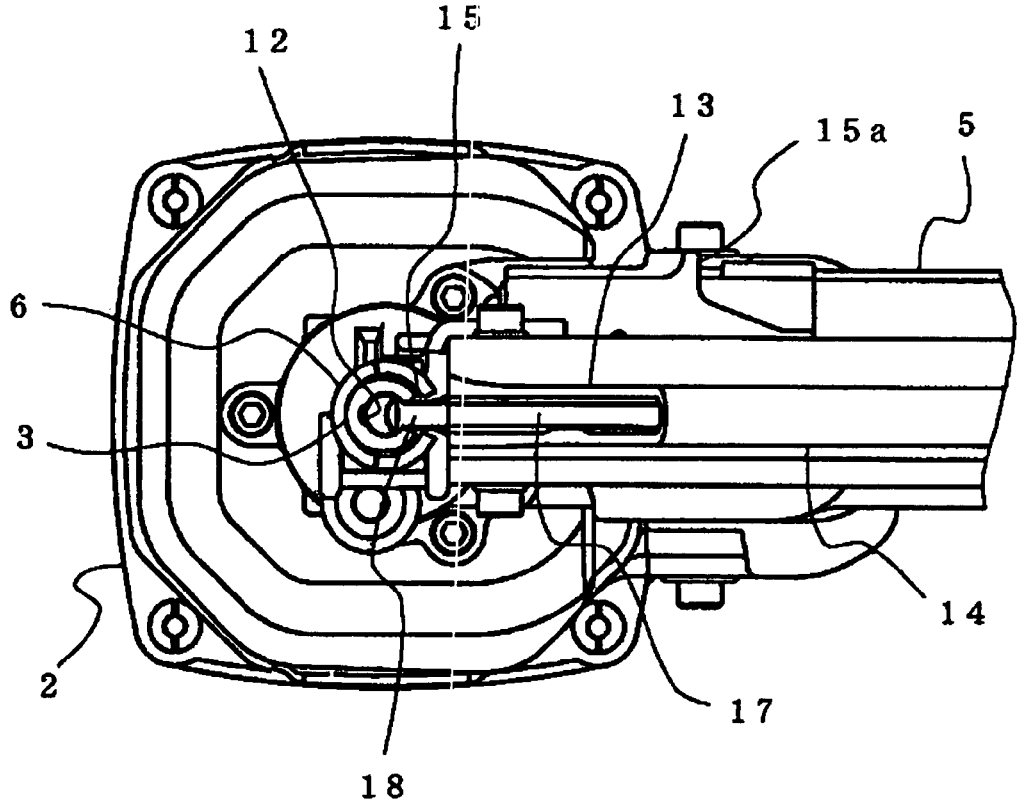
FIG. 4 is a bottom view showing a portion of the power drive nailing machine of FIG. 1.

As shown by FIG. 4, a front end portion of the magazine 5 is connected to a face of the nose portion 3 directed to a rear side. Therefore, a connected nail containing portion 17 formed between the pair of side walls 13, 14 arranged to be opposed to each other by being spaced apart from each other by a predetermined interval therebetween is made to be continuous to inside of the injection port 12 by way of an opening 18 formed on a rear side of the nose portion 3. The connected nail charged into the connected nail containing portion 17 of the magazine 5 is pressed to be supplied by being urged to a front side of the magazine 5 by the pusher 15 engaged with the rearmost nail of the connected nail. As a result, a frontmost nail of the connected nail is supplied from the opening 18 to inside of the injection port 12 of the nose portion 3.

Figure 5:
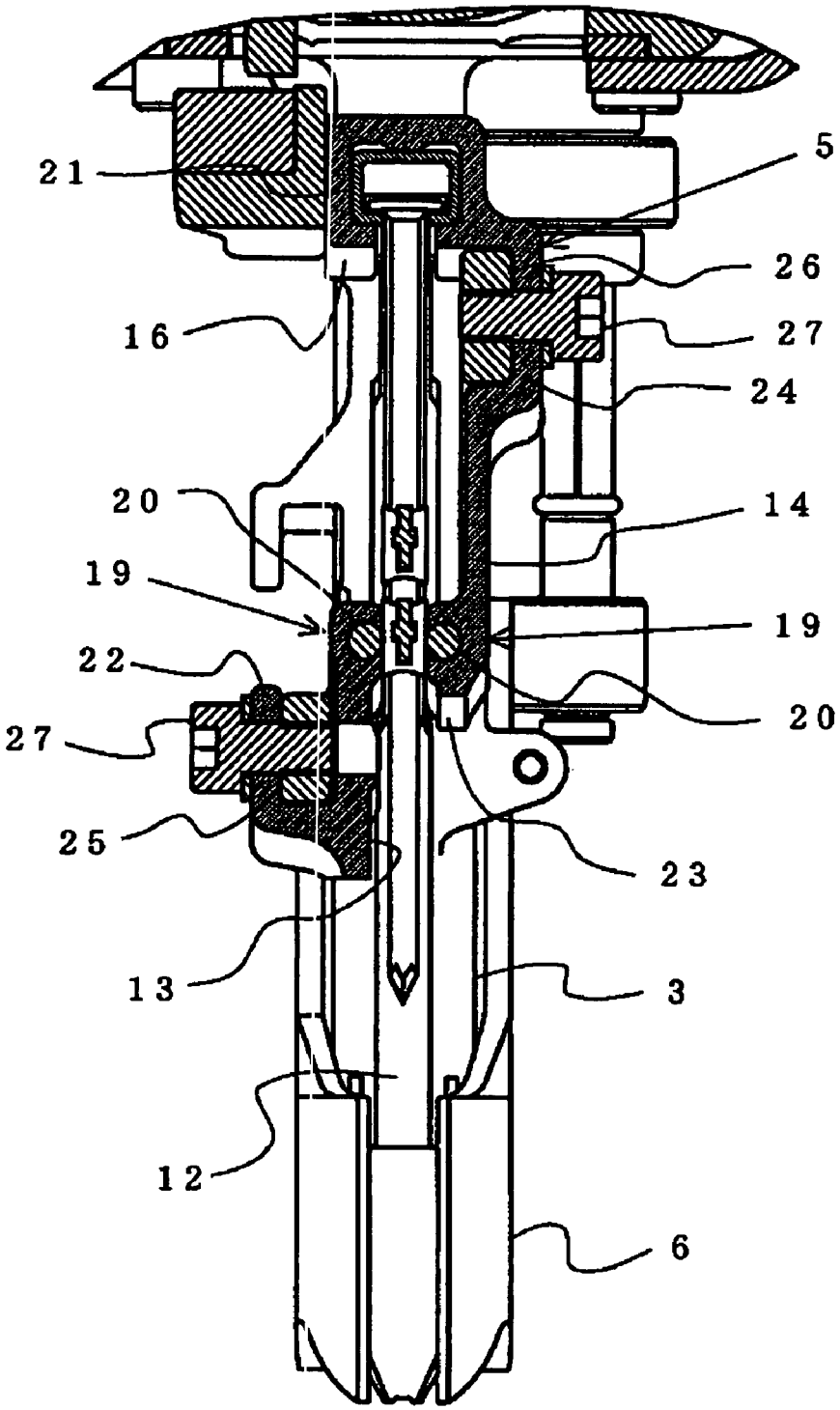
FIG. 5 is an enlarged sectional view taken along a line B-B of FIG. 3.

Further, as shown by FIG. 5, inner side faces of the two side walls 13, 14 of the magazine are formed with the guide portions 19 for introducing to guide the two side faces of the connected nail charged into the connected nail containing portion 17 of the magazine 5 to be opposed to each other. The guide portions 19 are provided with guide rods 20 respectively embedded to the pair of side walls 13, 14 to expose outer peripheral faces thereof to inside of the connected nail containing portion 17. The guide rod 20 is formed by a material having high wear resistance of a steel member or the like. The connected nail moving at inside of the magazine 5 is guided while being brought into contact with the guide rods 20. Therefore, a main body portion of the magazine 5 formed by a material of aluminum, a synthetic resin or the like is prevented from being worn by friction with the connected nail. Similarly, also a portion of containing a head portion of the connected nail is formed with a head guide 21 formed by a steel member. The main body portion of the magazine 5 is prevented from being worn by friction with the head portion of the nail. Further, a resin material having self lubricity and wear resistance of nylon resin or the like including glass fiber may be used for the guide rod 20 for preferably introducing to guide the connected nail. In this case, there is provided an advantage of achieving a reduction in cost, a reduction in weight in comparison with a case of using a steel member or the like.

A position in an up end down direction of the guide portion 19 is set to guide a side face of a portion proximate to a front end of a nail shaft portion of the connected nail having a shortest size used in the power drive nailing machine 1. The opening portion 16 formed at the side wall 13 on one side is formed on a base end side (upper side of paper face of FIG. 5) of the nose portion 3 relative to the guide portion 19. Further, a front end side (lower side of paper face of FIG. 5) of the nose portion 3 of the front end portion of the side wall 13 is formed with the first attaching portion 22 for attaching the side wall 13 to the nose portion 3. Further, a front end of the side wall 14 on other side is formed with the notched portion 23 constituted by cutting to remove the side wall of the front end side portion of the nose portion 3 relative to the guide portion 19. Further, the side wall 14 of the base end side portion of the rose portion 3 relative to the guide portion 19 is formed with the attaching portion 24 for attaching the side wall 14 to the nose portion 3.

The nose portion 3 is formed with respective attaching pieces 25, 26 in correspondence with the first attaching portion 22 and the second attaching portion 24 respectively formed at the pair of side walls 13, 14 of the magazine 5 to be integrally projected to the rear side of the nose portion 3. A front end portion of the magazine 5 is attached to the nose portion 3 respectively by bolts 27 by fitting the attaching pieces 25, 26 to the first attaching portion 22 and the second attaching portion 24 of the magazine 5. Further, as shown by FIG. 1, the rear portion of the magazine 5 is connected to a rear end of the grip portion 4 by way of the bracket 28.

As described above, the side wall 13 on one side of the magazine 5 is formed with the opening portion 16 up to the front end of the side wall 13, and in a state of attaching the magazine 5 to the nose portion 3, inside of the injection port 12 of the nose portion 3 disposed on the base end side of the nose portion 3 relative to the guide portion 19 can always face outside by way of the opening portion 16. Therefore, a clogged nail can be removed by applying a tool of a punch or the like to the clogged nail at inside of the injection port 12 from a portion of the opening portion 16. Further, a front end portion of the side wall 14 on other side is formed with the notched portion 23 at a portion on a front end side of the nose portion 3 relative to the guide portion 19. Therefore, in the state of attaching the magazine 5 to the nose portion 3, the inside of the injection port 12 of the nose portion 3 disposed on the front end side of the nose portion 3 relative to the guide portion 19 can always face outside by way of the notched portion 23. Therefore, a clogged nail can be removed by applying a tool of a punch or the like to the clogged nail at inside of the injection port 12 of the nose portion 3 from the notched portion 23.

Although explaining the embodiment, an explanation has been given of the combustion gas drive nailing machine formed with the combustion chamber 11 at inside of the housing 2 for striking a nail by driving the piston 9 by the pressure of the combustion gas generated at inside of the combustion chamber 11 as the power drive nailing machine 1, the invention can be embodied also in, for example, a compressed air drive nailing machine for striking a nail to a struck member of wood or the like by a driver coupled with a piston by driving the piston by compressed air by introducing compressed air supplied from a compressed air supply source by way of an air hose or the like into a cylinder.

Although the invention has been explained in details and with reference to the specific embodiment, it is apparent for the skilled person that the invention can variously be changed or modified without deviating from the spirit and the range of the invention.

The application is based on Japanese Patent Application (Japanese Patent Application No. 2004-296271) filed on Oct. 8, 2004, and the entire content of which are incorporated herein by reference.

INDUSTRIAL APPLICABILITY

A nail clogged at inside of the injection port of the nose portion is easily removed without a necessity of forming an openable/closable separate part at the nose portion or removing a magazine from the nose portion.

The invention claimed is:

1. A power drive nailing machine comprising:

a driver for striking a nail;

a nose portion including an injection port;

a magazine charged with connected nails, successively supplying the connected nails into the injection port and including a pair of side walls, the connected nails respectively including heads, shafts, and tip-ends;

guide portions respectively formed on the pair of side walls to be opposed to each other and engaged with a side face of the connected nails for guiding a portion of the nail shafts of the connected nails;

an opening portion formed in one of the pair of side walls on a driver end side of the nose portion at the nail head side relative to the guide portions; and a notched portion formed in the other of the pair of side walls on a discharge end side of the nose portion at the nail tip-end side relative to the guide portions, the driver end side of the nose portion being above the guide portions and the discharge end side of the nose portion being below the guide portions, wherein the opening portion and the notched portion provide access to the injection port to remove a clogged nail inside the injection port without detaching the magazine from the nose portion and without providing an openable/closable front plate at the nose portion.

2. The power drive nailing machine according to claim 1, further comprising:

a first attaching portion formed at the one of the pair of side walls on the discharge end side of the nose portion relative to the guide portion for attaching the magazine to the nose portion; and a second attaching portion formed at the other of the pair of side walls on the driver end side of the nose portion relative to the guide portion for attaching the magazine to the nose portion.

3. The power drive nailing machine according to claim 2, further comprising:

a first and a second attaching piece formed integrally with the nose portion and projected to a rear side;

wherein the first attaching portion is attached to the first attaching piece, and the second attaching portion is attached to the second attaching piece.

4. The power drive nailing machine according to claim 1, wherein the guide portion guides a side face of a portion of the connected nails having a shortest size capable of being used by the power drive nailing machine proximate to a front end of the nail shafts.

5. The power drive nailing machine according to claim 1, wherein the connected nails comprise a number of nails connected in a straight shape, and the magazine is constituted by a straight shape.

6. The power drive nailing machine according to claim 1, wherein the guide portions respectively include guide rods embedded in the side walls.

7. The power drive nailing machine according to claim 1, further comprising:

a pusher for urging the connected nails charged in the magazine to the injection port;

wherein the opening portion guides the pusher.

8. The power drive nailing machine according to claim 1, wherein the opening portion is configured as opened on the one of the pair of the side walls and the notched portion is configured as opened on the other of the pair of the side walls so that an inside of the injection part is always exposed to the outside.

* * * * *